US006133839A

United States Patent [19]

Ellul, Jr. et al.

[11] Patent Number: 6,133,839

[45] Date of Patent: Oct. 17, 2000

[54] SMOKE DETECTOR APPARATUS WITH EMERGENCY ESCAPE INDICATOR

[75] Inventors: Joseph A. Ellul, Jr.; Jack Padova, both of Lutz, Fla.

[73] Assignee: Ellul Enterprises, Inc., Lutz, Fla.

[21] Appl. No.: 09/289,032

[22] Filed: Apr. 9, 1999

Related U.S. Application Data

[60] Provisional application No. 60/081,600, Apr. 13, 1998.

[51] Int. Cl.[7] ..... G08B 17/00

[52] U.S. Cl. ..... 340/584; 340/539; 340/628; 340/629; 340/331; 340/332

[58] Field of Search ..... 340/584, 628, 340/539, 629, 331, 332, 531, 825.06, 825.36, 825.54

[56] References Cited

U.S. PATENT DOCUMENTS

| | | | |
|---|---|---|---|
| D. 360,156 | 7/1995 | Fenne | D10/106 |
| 3,461,283 | 8/1969 | Hahn | 362/235 |
| 4,148,023 | 4/1979 | Elkin | 340/628 |
| 4,283,657 | 8/1981 | Gordon et al. | 315/86 |
| 4,489,308 | 12/1984 | Logan, Jr. et al. | 340/628 |
| 4,517,555 | 5/1985 | Marsocci et al. | 340/522 |
| 4,524,304 | 6/1985 | Todd | 315/156 |
| 4,531,114 | 7/1985 | Topol et al. | 340/539 |
| 4,570,155 | 2/1986 | Skarman et al. | 340/531 |
| 4,694,285 | 9/1987 | Scripps | 340/693 |
| 4,763,115 | 8/1988 | Cota | 340/628 |
| 4,801,928 | 1/1989 | Minter | 340/691 |
| 4,827,244 | 5/1989 | Bellavia et al. | 340/514 |
| 4,901,056 | 2/1990 | Bellavia et al. | 340/514 |
| 5,019,805 | 5/1991 | Curl et al. | 340/628 |
| 5,140,301 | 8/1992 | Watanabe | 340/332 |
| 5,177,461 | 1/1993 | Budzyna et al. | 340/331 |
| 5,283,816 | 2/1994 | Gomez Diaz | 379/40 |
| 5,570,077 | 10/1996 | Swieboda | 340/331 |
| 5,578,989 | 11/1996 | Pedtke | 340/539 |
| 5,587,705 | 12/1996 | Morris | 340/628 |
| 5,594,410 | 1/1997 | Lucas et al. | 340/332 |
| 5,825,280 | 10/1998 | Merendini et al. | 340/326 |
| 5,889,468 | 3/1999 | Banga | 340/628 |
| 5,898,369 | 4/1999 | Godwin | 340/539 |

OTHER PUBLICATIONS

HITEC Group International, Inc., 1996 Catalog, Copyright 1995, HITEC Group Int'l, Inc.

Julian A. McDermott Corp., Safety Lighting Catalog.

ADA Enterprises, Inc., Product Catalog, Nov. 20, 1997.

*Primary Examiner*—Daniel J. Wu
*Assistant Examiner*—Toan Pham
*Attorney, Agent, or Firm*—Young & Basile, PC

[57] ABSTRACT

A warning apparatus provides an alarm indication of the location of an exit from an enclosure or room in the event of a detected fire as well as the safety of the exit. An alarm housing is located remote from a smoke detector on or in proximity to a surface of the exit. The smoke detector output is an ultrasonic frequency signal generated upon detection of a fire. The ultrasonic signal is detected by a receiver carried by the alarm which activates the alarm. The alarm is in the form of at least one, and preferably both of a visible light and an audible alarm mounted within the alarm housing. A temperature sensor on the alarm housing detects the temperature of the exit surface and deactivates the alarm if the temperature exceeds the predetermined safe temperature. A test circuit is included in the smoke detector or on a separate transmitter which, when activated, transmits an ultrasonic signal to the receiver to test the proper operation of the alarm.

18 Claims, 3 Drawing Sheets

SMOKE DETECTOR APPARATUS WITH EMERGENCY ESCAPE INDICATOR

CROSS REFERENCE TO CO-PENDING APPLICATION

This application claims the benefit of the priority date of co-pending provisional patent application Ser. No. 60/081,600 filed Apr. 13, 1998 in the names of a Joseph A. Ellul, Jr. and Jack Padova, and entitled SMOKE DETECTOR APPARATUS WITH EMERGENCY ESCAPE INDICATOR.

BACKGROUND OF THE INVENTION

1. Field of the Invention

The present invention relates, in general, to smoke detectors.

2. Description of the Art

Smoke detectors are typically mounted in various rooms of a home, such as bedrooms, hallways and at one or both ends of stairs to provide an early indication of the presence of smoke generated during the initial stages of a fire to enable the occupants to safely escape from the home.

It is also known to construct smoke alarm warning systems which include a light source to provide emergency illumination. Such devices are typically employed in hallways and similar exit areas of a building and come into play when the main power supply of the building fails during a fire. The high intensity flashing strobe light is capable of being seen despite intense smoke which may fill a hallway or room. Nevertheless, such smoke detector/light warning systems do provide an indication of an exit to enable an occupant to escape from a burning building or home.

It is also known to provide a smoke detector/warning light system which includes a standard smoke detector mountable in a normal location on the ceiling of a room and a remote, separate light indicator unit which includes a light and a microphone for receiving the audible alarm signals generated by the smoke detector sound generator. The flashing light housing is designed to be mounted on a window for visibility exteriorly of the building to identify the room where smoke has been detected so that rescuers will know where to go to put out the fire and/or rescue occupants of a burning building or home. This device utilizes a radio frequency transmitter in the smoke detector and a receiver in the light housing. The radio frequency signals can activate light devices which may be remote from the smoke detector and not positioned to detect the audible sounds generated by the smoke detector.

While such smoke detector/warning light devices effectively provide an illuminatable light adjacent an exit to mark the location of an exit to enable an occupant of a burning building to safely escape from the building, such devices provide no indication as to whether or not the escape path through the exit, such as a door, or archway into an adjoining hall, stairway, or other rooms of the building, is actually safe for use as an escape path. Frequently, a fire can be burning on the other side of a wall and not yet penetrate a room when the door to the hallway is closed. Smoke passing through openings along the edges of the door or otherwise may still penetrate into the closed room in sufficient amounts to activate the smoke detector. An occupant attempting to escape through the door may actually encounter the fire itself and, when opening the door, allow dense smoke to enter the room and/or create a potential "backdraft" situation where fire in the adjoining room or hallway literally explodes into the room.

It would be desirable to provide a smoke detector with warning light apparatus which is capable of providing a safe or not safe indication of an escape exit during a fire.

SUMMARY OF THE INVENTION

The present invention is a warning apparatus particularly suited for indicating a safe exit from an enclosure, such as a building, house, or room within a building or a house in the event of a detected fire.

According to one aspect of the invention, the warning apparatus comprises:

- a detector capable of sensing and generating an output signal indicative of a fire in an enclosure having at least one escape exit;
- a transmitter responsive to the output signal of the detector for transmitting a signal frequency upon receiving the output signal from the detector;
- at least one distinct alarm remotely mounted from the detector on a surface in close proximity to the escape exit, the alarm including a light source capable of generating visible light;
- a receiver, carried with the alarm and responsive to a signal frequency from the transmitter means, the receiver activating the light source upon receiving the signal frequency from the transmitter; and
- a temperature sensor, coupled to the alarm, for sensing the ambient temperature adjacent to the alarm, the temperature sensor generating an output signal upon detecting a temperature above a predetermined threshold temperature, the output signal deactivating the light source in the alarm.

Preferably, the alarm comprises at least one and, more preferably, both a visible light and an audible alarm. Preferably the light is a pulsed strobe light.

The temperature sensor, according to one aspect of the invention, is a thermistor carried on the alarm housing. The thermistor is preferably optocoupled to a switch for selectably connecting and disconnecting electrical power to the alarm to deactivate the alarm, including both of the visible light and the audible alarm, when the output signal from the temperature sensor indicates a higher exit temperature as compared to a predetermined safe temperature.

According to another aspect of the present invention, the transmitter and receiver are preferably an ultrasonic frequency transmitter and an ultrasonic frequency responsive receiver.

According to another aspect of the present invention, a test transmitter generates a signal frequency, when activated, to the receiver to test the proper operation of the receiver. According to one aspect of the invention, the test transmitter can be a portable transmitter carried by a user. A receiver can be added to the smoke detector and coupled to the smoke detector output circuit to activate the smoke detector output to generate an audible alarm upon detecting a matched frequency signal from the test transmitter. The test transmitter may also be used by itself to test the operation of conventional smoke detectors where a separate signal frequency receiver is mounted in the smoke detector and coupled to the smoke detector output for activating the audible alarm of the smoke detector upon receiving a matching signal frequency from the test transmitter.

The warning apparatus of the present invention uniquely provides a safe or non-safe indication of an exit from a building or room within a building in the event of a detected fire. The remote alarm housing of the present invention is mountable on any escape surface, such as a door, window, etc. The use of at least one and preferably both of a visible light and an audible alarm in the alarm housing provides enhanced safety by leading an occupant to a safe exit both visually and audibly, even if the room is filled with dense smoke.

The temperature sensor uniquely senses the temperature of the exit closure and, if a temperature exceeding a predetermined safe temperature is detected, such as would occur in the event of fire on the opposite side of the closure, the temperature sensor output signal, through a control circuit, deactivates the alarm so as not to lead an occupant to a non-safe exit and, also, to prevent an occupant from opening the closure which could lead to a dangerous backdraft condition.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENT

Figure 1:
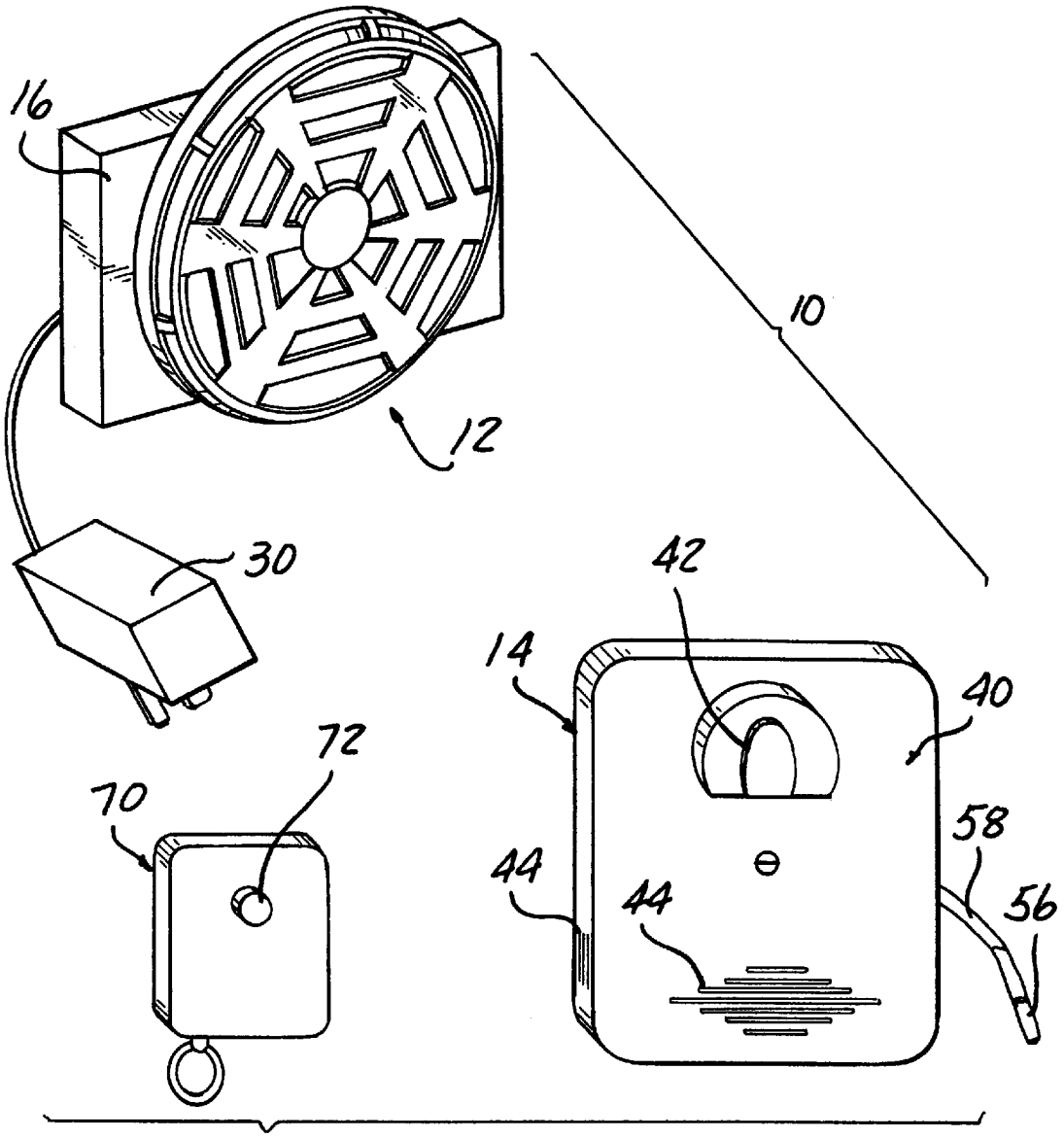
FIG. 1 is a perspective view of the components of the smoke detector with emergency escape indication apparatus according to the present invention.

Referring now to FIG. 1, there is depicted a smoke detector with emergency escape indication apparatus 10 which includes a smoke detector 12 and a remote alarm 14.

The smoke detector 12 may be any conventional, commercially available smoke detector which is capable of detecting smoke and generating an output signal typically used to activate an alarm. The smoke detector 12 may be connectable to 110 VAC power, internal replaceable batteries and/or 110 VAC power with battery backup adapted for trickle recharging when AC power is available.

Figure 2:
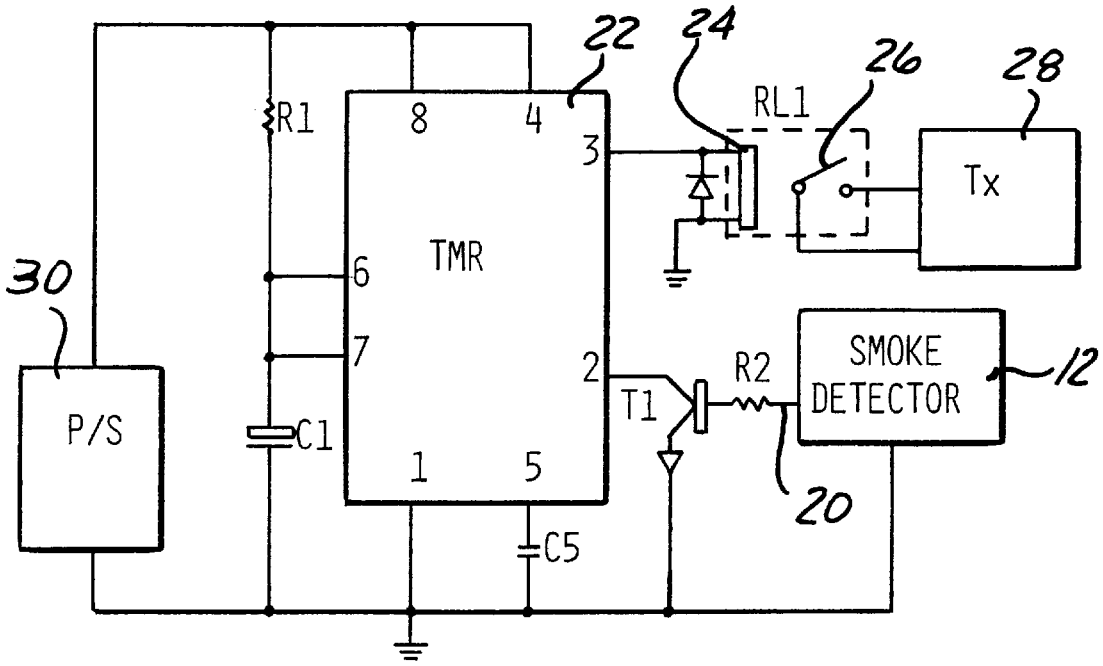
FIG. 2 is a schematic diagram of the alarm circuit of the present invention.

A housing 16 is connected to the smoke detector housing 12 and contains the circuitry for an alarm circuit described hereafter and shown in FIG. 2.

Before describing the circuitry of FIG. 2, it will be understood that although the following discussion describes the audible alarm as mounted in the alarm apparatus 14, and not in the smoke detector 12, as is more conventional, the present apparatus may also utilize the conventional audible alarm in a smoke detector as a backup or general fire/smoke alarm.

Power is supplied to the alarm circuit by a power supply 30. As described above, the power supply 30 may be, by example, a 12 volt DC power supply with internal battery backup. Such a power supply utilizes a transformer which is connected to 110/120 volt AC and a rectifier bridge to convert the AC power to the DC power levels required for the integrated circuits and other electronic components of the alarm circuit shown in FIG. 2. As is conventional, battery backup may be provided for the power supply 30 which is activated with the main AC power is interrupted. Alternately, storage batteries may be employed in the power supply 30 as the main source of power for the alarm circuit 10.

The alarm circuit shown in FIG. 2 is electrically connected to an output 20 of the smoke detector 12. As is conventional, when smoke enters the chamber of the smoke detector 12, a 2 Hz output pulse or signal develops across an internal capacitor within the smoke detector 12. This output signal 20 is connected through resistor R2 to the base of transistor T1 and drives transistor T1 into conduction which brings pin 2 of a timer 22 low or to ground. The timer 22 may be any conventional timer, such as an integrated circuit timer model No. NE555P. The purpose of the timer 22 is to stretch 2 Hz output signal 20 from the smoke detector 12. Any output time period may be selected by the use of appropriate sized resistor R1 and capacitor C1.

As also shown in FIG. 2, capacitor C2 is connected between one pin of the timer 22 and ground and acts as a spike arrestor.

As soon as pin 2 of the timer 22 goes low or to ground, output pin 3 of the timer 22 goes high for a time period set by resistor R1 and capacitor C1 connected to input pins 6 and 7, respectively, of the timer 22. For example, appropriate values are selected for R1 and C1 to create a 5 second time period output. Thus, in this example, the output on pin 3 of the timer 22 goes high for five seconds and activates a coil 24 of a relay RL1. When the coil 24 is activated, the switchable contact 26 of the relay RL1 closes and supplies power to the trigger pin of a transmitter means 28.

In a preferred embodiment, the transmitter means 28 is a transmitter capable of generating an ultrasonic frequency signal. Ultrasonic frequencies are preferred to prevent interference or unintentional activation of the apparatus 10 of the present invention by radio frequency signals which are commonly employed in other devices found in a home or building, such as garage door openers, television remote controls, etc.

If, at the end of the five second time period, smoke is still detected by the smoke detector 12, the output signal 20 from the smoke detector 12 will still be present thereby causing the timer 22 to restart a new time period and continue to supply a high output from pin 3 to maintain the coil 24 of relay RL1 activated and the transmitter 28 continuing to transmit an ultrasonic signal.

Figure 4:
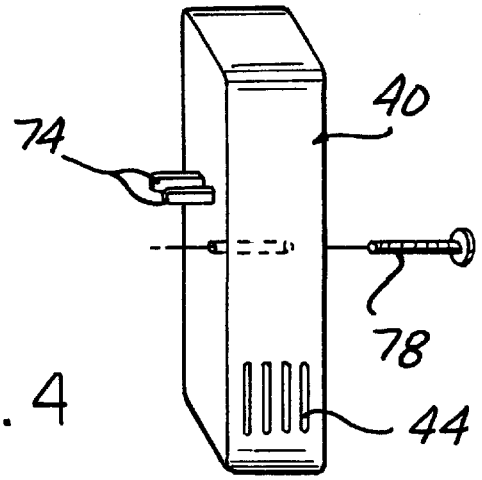
FIG. 4 is a perspective view showing the connection and mounting arrangement for the alarm housing of the present invention.

As shown in FIGS. 1 and 4, the alarm apparatus 14 is mounted in a housing 40 which may take any shape. The housing 40 supports an internal printed circuit board carrying the receiver circuit shown in FIG. 3. A light 42 is mounted in the housing 40 and projects from the housing 42 for external visibility. Vents 44 may also be formed on the front of the housing 40 and or on the sides of the housing 40 to allow audible alarm sounds to escape from the housing 40.

The light 42 is preferably a high intensity strobe light, such as one sold by Radio Shack as part No. 49-220. This particular strobe light 42 is provided with its own internal battery power supply. Further, the switchable contact 52 of the relay RL2 is connected in parallel across the normal on/off slide switch found on this particular strobe light 42.

Figure 3:
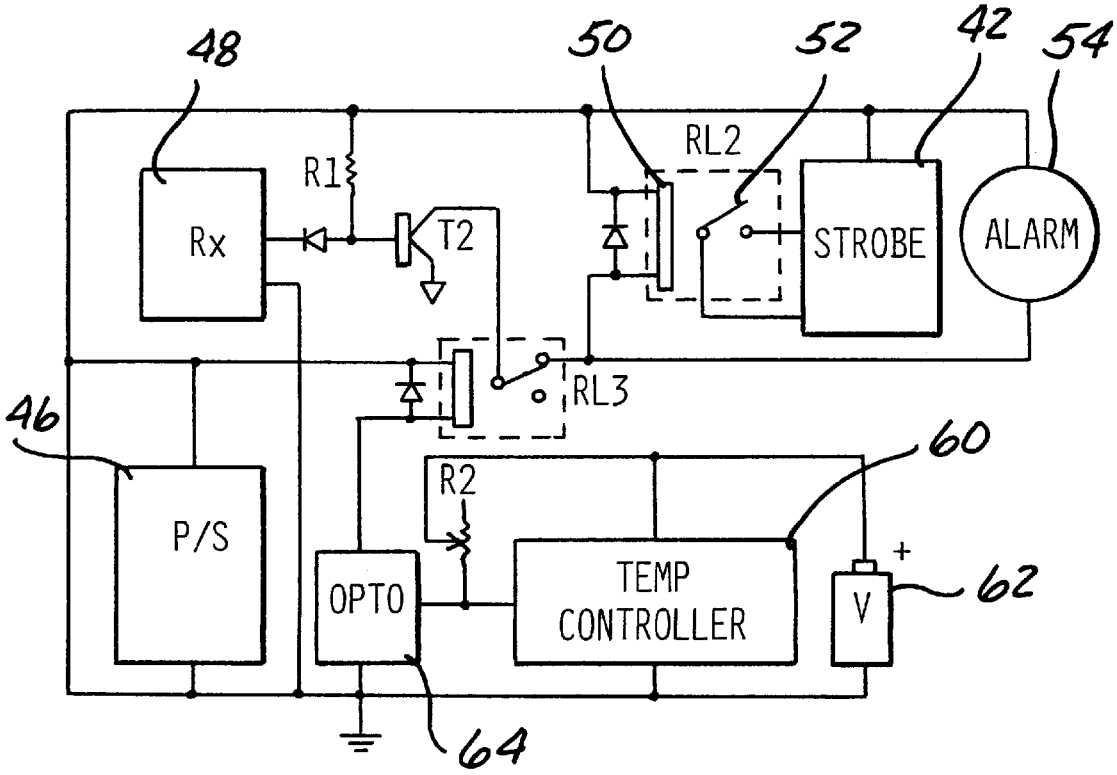
FIG. 3 is a schematic diagram of the receiver circuit of the present invention.

As shown in FIG. 3, the receiver circuit is also provided with a separate power supply 46 such as a 12 volt DC power supply with battery backup. Alternately, 110 volt AC power or even storage batteries may be employed as the power supply 46.

The receiver circuit also includes a receiver 48, such as an ultrasonic receiver, capable of detecting the ultrasonic frequency signals generated by the transmitter 28.

By way of example only, the transmitter 28 and receiver 48, used in the present apparatus are those found in a remote control power switch sold by Radio Shack, part No. 61-26667.

In operation, when the receiver 48 detects a matching ultrasonic frequency signal from the transmitter 28, an output from the receiver 48 drives transistor T2 into conduction which supplies power to the coil 50 of relay RL2. Activation of the coil 50 causes the switchable contact 52 of the relay RL2 to close thereby supplying power to the light 42 which is preferably in the form of a high intensity, strobe light. It should also be noted that transistor T2, when driven to conduction by an output from the receiver 48 also supplies power to an audible alarm 54 which can be an audible alarm of the type typically found in smoke detectors, such an audible alarm which generates 85 db sound.

According to a unique feature of the present invention, a temperature sensing means is provided for sensing the ambient temperature of a wall or other surface immediately adjacent the alarm housing 40, such as the wall or surface on which the alarm housing 40 is mounted, or the ambient temperature of the air immediately surrounding the housing 40.

In one embodiment, the temperature sensing means includes a thermistor or probe 56 which is connected by a conductor 58 to a temperature controller or comparison circuit within the housing 40. Alternately, a thermistor may be mounted within the housing 40 adjacent to the vents 44 so as to be disposed immediately adjacent to a wall or other surface on which the housing 40 is mounted for sensing the temperature of the adjacent wall or surface.

In the present embodiment, which is described by way of example only, the temperature sensing means is a temperature controller 60, model No. HED043, which is provided with its own 1.5 volt battery power supply. The temperature controller 60 includes an adjustable high temperature set point. When the set point is exceeded by a temperature reading from the thermistor 56, the controller 60 generates an output signal on pin 3 which goes high for ten seconds and triggers an optocoupler 64. When triggered, output pin 5 of the optocoupler 64 goes low to activate a coil 66 of a relay RL3. When the coil 66 is activated, the normally closed switchable contact 68 of relay RL3 opens disconnecting power to the coil 50 of relay RL2 and the alarm 54. This immediately deactivates the strobe light 42 and the alarm 54.

Figure 5:
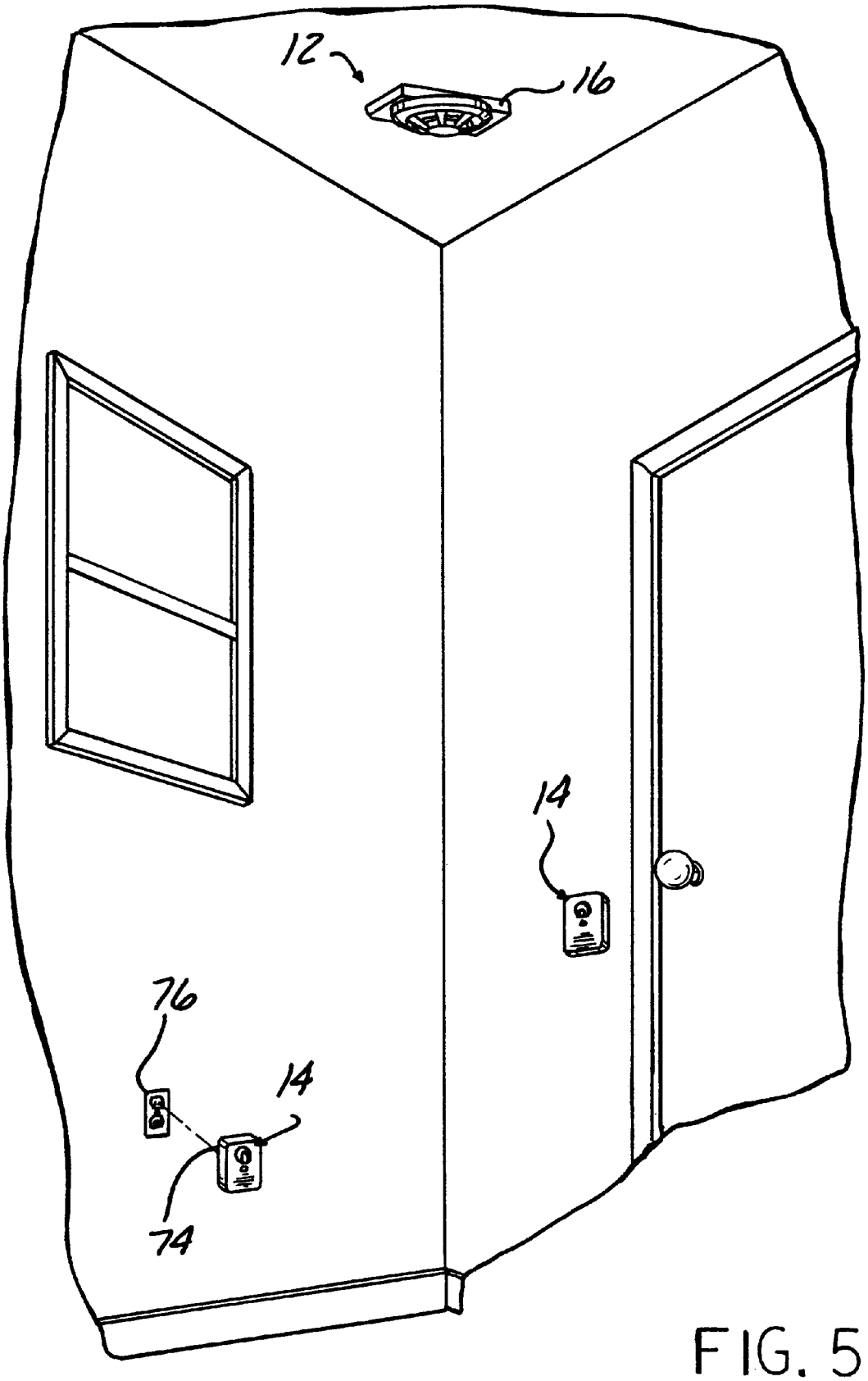
FIG. 5 is a perspective, pictorial representation of the mounting position of the apparatus of the present invention.

In use, as shown in FIG. 5, the smoke detector 12 will be mounted in one of the normal locations within a room typical for smoke detectors, such as on the ceiling of a room. The smoke detector 12 will be connected to 110 AC electrical power or provided with its own internal battery power.

One alarm 14 is then mounted immediately adjacent to one exit from the room. Possible locations include on or immediately adjacent to a door controlling access to the room from an adjacent room, hallway etc., a window or an open archway opening into an adjacent room or hallway. The alarm 14 could also be mounted on a door opening to a stairway from a hallway. The alarm housing 40 is mounted to such a surface by conventional fasteners. Since the mounting locations may vary, the housing 40, as described above, can be provided with multiple power supplies including storage batteries thereby enabling the housing 40 to be mounted at any desired location without regard to the availability of AC electric power. As shown in FIGS. 4 and 5, the housing 40 may be provided with a conventional electric outlet plug terminals 74, enabling the housing 40 to be plugged into a conventional 110 VAC electrical output 76. This application would be suitable where an electric outlet is located in close proximity to a doorway, window or other room exit. A mounting screw 78, shown in FIG. 4, through an aperture in the housing 40 into the standard threaded cover plate mounting aperture in an electrical outlet 76.

With both the smoke detector 12 and the alarm(s) 14 in a power on state, smoke detector 12 will generate an ultrasonic output signal immediately upon detecting smoke within an internal chamber within the smoke detector 12. This ultrasonic signal is transmitted over an area, such as through an entire room or up to 100 feet, for example, from the smoke detector 12, and is received by all of the alarms 40 within the range of the smoke detector 12 and transmitter 28. As described above, when the receiver 48 of the alarm 40 receives a matching frequency ultrasonic signal, electric power is immediately supplied to the audible alarm 54 and, through relay RL2, to the strobe light 42 thereby providing an audible indication as well as a visual indication of the location of an exit by the flashing high intensity strobe light and the audible 85 db sound.

It will be understood that multiple alarms 14 may be employed in a single room, each identifying a different exit from the room. This increases the safety for the occupant(s) of the room since multiple exits are indicated. Each of the alarms 14 will be keyed to the same ultrasonic frequency of the transmitter 28 in the alarm circuit of the smoke detector 12 so as to be activated at the same time.

However, according to the unique temperature sensing means of the present invention, if the temperature sensing means of any alarm 14 detects a temperature exceeding the preset set temperature set point, which would indicate the presence of heat and therefore fire on the other side of the wall, door or surface on which the alarm 14 is mounted, the temperature sensing means, will cause the strobe 42 and audible alarm 54 to be deactivated. This removes one particular exit as a viable escape path for an occupant since the strobe 42 will not be visible and the audible alarm 54 associated with the particular deactivated strobe 42 will be silenced. The other alarms 14 within the room can still direct an occupant to a safe exit where the ambient temperature on the other side of the wall, door or window is lower than the set point temperature.

In order to adjustably set the set point, the temperature controller or temperature sensing means 60 is provided with an adjustment enabling the set point to be selected as needed. Due to the thickness of various wall materials, such as drywall, wood, and/or the presence of insulation between drywall or wood panels, the temperature set point will be significantly lower than what would be considered a safe ambient temperature to enable an escape from a room. For example, a temperature set point of 160° F. within a room may indicate an ambient temperature of 600° F. or more on the other side of the wall or door, such as in an adjoining room, hallway, etc. Since it would not be safe for an occupant to go through such an exit into the adjoining hallway or room where temperatures are at least at 600° F., the temperature sensing means 60 uniquely deactivates the strobe 42 and alarm 54 of one receiver circuit thereby removing any visual or audible indication that the exit associated with that particular alarm is safe for use.

Since the smoke detector 12 is activated by smoke, the presence of dense smoke may initially confuse an occupant of a room when awakened or otherwise alerted by the activation of the various audible alarms 54 on the alarm devices 14 spaced throughout a given room. However, only those alarms 54 and strobe lights 42 associated with safe exits will remain activated. The audible alarm 54 can still be heard through the smoke and the high intensity strobe 42 will be visible to lead an occupant safely from the room through a safe exit.

Also included in the present invention is a remote test device 70 shown in FIG. 1. The remote test device 70 is capable of remotely testing the alarm 14. A housing includes a pushbutton 72 which, when depressed, activates an internal transmitter which can be identical to the ultrasonic transmitter 28 in the alarm circuit. The transmitter generates an ultrasonic signal which is received by the receiver 48 in each alarm 14 and causes each alarm 14 to activate its respective strobe light 42 and audible alarm 54. In this manner, proper operation of each alarm 14 can be checked without generating smoke adjacent to the smoke detector 12. The smoke detector 12 can be tested by depressing the push button 7 on the smoke detector 12.

This remote test device can also be employed with conventional smoke detectors through the addition of a receiver to the smoke detector output circuit which activates the smoke detector output to generate an audible alarm upon detecting a matched frequency signal from the remote test device. Any type of frequency signals, such as radio frequency, ultrasonic signals, etc., may also be employed for this application.

In summary, there has been disclosed a smoke detector with emergency escape indication apparatus which provides several advantages over simple smoke detectors. The present apparatus, in addition to providing a normal smoke detector audible alarm upon detecting a fire, houses the alarm in a remote housing which is mountable adjacent an escape exit from an enclosure, such as building, room within a building or house, etc. In addition to the audible alarm, a high intensity light is mounted on the alarm housing and activated in conjunction with the audible alarm to provide an additional visual signal of the location of the escape exit. Both of the audible and the visual indicator are extremely useful in leading an occupant of a room to the location of a safe exit even when the room is filled with smoke.

More importantly, the present apparatus has a temperature sensor coupled to the alarm housing for sensing the temperature of the escape exit itself. In the event the temperature of the escape exit is above a predetermined temperature threshold, such as would occur when a fire is present on the other side of the escape exit or door from the room or enclosure containing the alarm apparatus of the present invention, the alarm apparatus automatically deactivates the audible alarm and the visual indicator so that an occupant is not led to a non-safe exit.

What is claimed is:

1. A warning apparatus comprising:

a detector capable of sensing and generating an output signal indicative of a fire in an enclosure having at least one escape exit;

a transmitter responsive to the output signal of the detector for transmitting a signal frequency upon receiving the output signal from the detector;

at least one distinct alarm carried in a housing remote from the detector and adapted to be fixedly mounted on a surface in the enclosure in close proximity to the escape exit of the enclosure;

a receiver, carried with the alarm and responsive to the signal frequency from the transmitter means, the receiver activating the alarm upon receiving the signal frequency from the transmitter means; and a temperature sensor coupled to the alarm and disposed in the housing in a position for sensing the ambient temperature of the surface of the enclosure adjacent to the alarm and indirectly the temperature of an opposing side of the surface, the temperature sensor generating an output signal upon detecting a temperature above a predetermined threshold temperature, the output signal deactivating the alarm to indicate an unsafe state of use of the escape exit.

2. The warning apparatus of claim 1 wherein the temperature sensor comprises a thermistor carried with the alarm.

3. The warning apparatus of claim 1 wherein the alarm comprises:

at least one of a visible light and an audible alarm.

4. The warning apparatus of claim 3 herein the visible light comprises a pulsed strobe.

5. The warning apparatus of claim 1 wherein the alarm comprises:

a housing, the receiver and temperature sensor mounted in the housing.

6. The warning apparatus of claim 5 wherein the alarm comprises one of a visible light and an audible alarm.

7. The warning apparatus of claim 6 wherein the alarm comprises both a visible light and an audible alarm.

8. The warning apparatus of claim 1 wherein the transmitter and the receiver comprise an ultrasonic frequency transmitter and an ultrasonic frequency responsive receiver.

9. The warning apparatus of claim 1 further comprising:

an optocoupler coupling the output of the temperature sensor to a switch; and the switch selectively connecting electrical power to the alarm.

10. The warning apparatus of claim 1 further comprising:

a test transmitter generating a test signal frequency, when activated; and the receiver activating the alarm upon receiving the test signal frequency.

11. A warning apparatus comprising:

a detector capable of sensing and generating an output signal indicative of a fire in an enclosure having at least one escape exit;

a transmitter responsive to the output signal of the detector for transmitting a signal frequency upon receiving the output signal from the detector;

at least one distinct alarm remotely mounted from the detector on a surface in close proximity to the escape exit, the alarm including a light source capable of generating visible light;

a receiver, carried with the alarm and responsive to the signal frequency from the transmitter means;

a first switch responsive to an output of the receiver for connecting electrical power to the alarm;

a temperature sensor, coupled to the alarm, for sensing the ambient temperature adjacent to the alarm, the temperature sensor generating an output signal upon detecting a temperature above a predetermined threshold temperature; and a second switch responsive to the output signal of the temperature sensor for deactivating the first switch to deactivate the alarm.

12. A warning apparatus for indicating a safe exit from an enclosure having at least one exit in the event of a fire, the warning apparatus comprising:

a detector capable of sensing and generating an output signal indicative of a fire in an enclosure having at least one escape exit;

a transmitter responsive to the output signal of the detector for transmitting a signal frequency upon receiving the output signal from the detector;

an alarm formed of at least one of a visible light and an audible alarm carried in a housing and adapted to be remotely mounted from the detector in close proximity to the at least one exit of the enclosure;

a receiver, carried with the alarm and responsive to the signal frequency from the transmitter means, the receiver activating the alarm upon receiving the signal frequency from the transmitter means; and a temperature sensor, coupled to the alarm and disposed in the housing, for sensing the ambient temperature adjacent to the alarm, the temperature sensor generating an output signal upon detecting a temperature above a predetermined threshold temperature, the output signal deactivating the alarm.

13. The warning apparatus of claim 12 wherein:

the alarm comprises both a visible light and an audible alarm.

14. The warning apparatus of claim 12 wherein:

the temperature sensor comprises a thermistor carried with the alarm.

15. The warning apparatus of claim 12 further comprising:

a test transmitter generating a test signal frequency, when activated; and the receiver activating the alarm upon receiving the test signal frequency.

16. The warning apparatus of claim 15 wherein the test transmitter is remote from the receiver.

17. A warning apparatus for indicating a safe exit from an enclosure having at least one exit in the event of a fire, the warning apparatus comprising:

a detector capable of sensing and generating an output signal indicative of a fire in an enclosure having at least one escape exit;

a transmitter responsive to the output signal of the detector for transmitting a signal frequency upon receiving the output signal from the detector;

an alarm formed of at least one of a visible light and an audible alarm adapted to be remotely mounted from the detector in close proximity to the at least one exit;

a receiver, carried with the alarm and responsive to the signal frequency from the transmitter means;

a first switch responsive to an output of the receiver for connecting electrical power to the alarm;

a temperature sensor, coupled to the alarm, for sensing the ambient temperature adjacent to the alarm, the temperature sensor generating an output signal upon detecting a temperature above a predetermined threshold temperature; and a second switch responsive to the output signal of the temperature sensor for deactivating the first switch to deactivate the alarm.

18. The warning apparatus of claim 17 further comprising:

an optocoupler coupling the output of the temperature sensor to a switch; and the switch selectively connecting electrical power to the alarm.

* * * * *